US009302862B2

(12) United States Patent
Taoka

(10) Patent No.: US 9,302,862 B2
(45) Date of Patent: Apr. 5, 2016

(54) IMAGE FORMING SYSTEM AND SHEET FEEDING UNIT

(71) Applicant: CANON KABUSHIKI KAISHA, Tokyo (JP)

(72) Inventor: Keitaro Taoka, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/505,752

(22) Filed: Oct. 3, 2014

(65) Prior Publication Data

US 2015/0102549 A1 Apr. 16, 2015

(30) Foreign Application Priority Data

Oct. 11, 2013 (JP) ..... 2013-213991
Oct. 2, 2014 (JP) ..... 2014-203686

(51) Int. Cl.

| | |
|---|---|
| ***G03G 15/00*** | (2006.01) |
| ***B65H 3/44*** | (2006.01) |
| ***B65H 1/26*** | (2006.01) |
| ***B65H 1/04*** | (2006.01) |
| ***B65H 1/14*** | (2006.01) |
| ***G03G 21/16*** | (2006.01) |

(52) U.S. Cl.

CPC .. *B65H 1/14* (2013.01); *B65H 1/04* (2013.01); *B65H 1/266* (2013.01); *B65H 3/44* (2013.01); *G03G 15/6502* (2013.01); *G03G 21/1619* (2013.01); *G03G 21/1647* (2013.01); *G03G 21/1695* (2013.01); *B65H 2402/40* (2013.01); *B65H 2402/62* (2013.01); *B65H 2405/15* (2013.01); *B65H 2801/06* (2013.01); *G03G 2221/1696* (2013.01)

(58) Field of Classification Search

CPC ..... B65H 3/44; B65H 1/04; B65H 1/266; B65H 1/14; G03G 15/6502; G03G 15/6508; G03G 15/6514; G03G 21/1619; G03G 21/1647

See application file for complete search history.

(56) References Cited

U.S. PATENT DOCUMENTS

| | | | | |
|---|---|---|---|---|
| 5,280,898 | A * | 1/1994 | Nakano et al. | 271/9.11 |
| 5,765,825 | A * | 6/1998 | Watase | 271/9.13 |
| 8,870,178 | B2 | 10/2014 | Taoka et al. | |
| 2006/0239771 | A1 * | 10/2006 | Hayashi et al. | 403/300 |
| 2014/0212167 | A1 * | 7/2014 | Agata | 399/107 |

FOREIGN PATENT DOCUMENTS

| | | | |
|---|---|---|---|
| JP | 59078031 | A * | 5/1984 |
| JP | 2007-326655 | A | 12/2007 |

* cited by examiner

*Primary Examiner* — Luis A Gonzalez
(74) *Attorney, Agent, or Firm* — Fitzpatrick, Cella, Harper & Scinto

(57) ABSTRACT

An image forming system includes an image forming apparatus, a sheet feeding apparatus, and a connection device. The connection device is interposed between the image forming apparatus and the sheet feeding apparatus, and connects the sheet feeding apparatus to the image forming apparatus so as to be detachable therefrom. The connection device includes a first exterior portion attached to the image forming apparatus, and configured to surround an access portion by a portion thereof being open, and a second exterior portion attached to the sheet feeding apparatus, fitted to an opening portion of the first exterior portion in a state where the sheet feeding apparatus is mounted on the image forming apparatus via the connection device, and configured to surround the access portion together with the first exterior portion.

20 Claims, 9 Drawing Sheets

IMAGE FORMING SYSTEM AND SHEET FEEDING UNIT

BACKGROUND OF THE INVENTION

1. Field of the Invention

The present invention relates to a sheet feeding unit which can feed a sheet to an image forming apparatus from outside, and to an image forming system including the sheet feeding unit.

2. Description of the Related Art

In the related art, an image forming apparatus is known which can be connected to a mass storage sheet feeding apparatus which stores a large quantity of sheets in order to reduce a number of a replenishment of sheets and to improve productivity or the like, when an image is formed on the large quantity of sheets. In particular, in an image forming apparatus such as a copier which is installed on a floor, an image forming system is often configured by connecting the mass storage sheet feeding apparatus (side deck) to a side of an image forming apparatus.

In recent years, various types of image forming apparatuses having different performance in productivity or printing accuracy are available, and thus, these image forming apparatuses have various sizes and configurations. Therefore, if one type of the mass storage sheet feeding apparatus (hereinafter, referred to as a "sheet feeding apparatus") is generally used to various types of image forming apparatuses, in some cases, a position of a receiving port in the image forming apparatuses which receives the sheet supplied from the sheet feeding apparatus is different depending on the image forming apparatuses and the sheet feeding apparatus is not able to connecting to the image forming apparatuses.

Therefore Japanese Patent Application Laid-open No. 2007-326655 discloses an image forming system in which a connection unit is disposed between the sheet feeding apparatus and the image forming apparatus, in order to convey the sheet discharged from the sheet feeding apparatus to the receiving port of various types of image forming apparatuses having different position of the receiving port for the sheet. By the way, generally, if a sheet jam occurs in the image forming system, a sheet stays in the image forming system, therefore it is necessary to remove the staying sheet. And it is desired that the sheet staying in the image forming system is efficiently removed in the image forming system providing the connection unit between the image forming apparatus and the sheet feeding apparatus.

SUMMARY OF THE INVENTION

According to a first aspect of the present invention, there is provided an image forming system comprising: an image forming apparatus including an apparatus main body having an access portion accessible to an inside of an apparatus, and an image forming portion provided in the apparatus main body, and forming an image on a sheet; a sheet feeding apparatus capable of feeding the sheet to the image forming apparatus from an outside of the apparatus main body; and a connection device interposed between the image forming apparatus and the sheet feeding apparatus, and connecting the sheet feeding apparatus to the image forming apparatus such that the sheet feeding apparatus is detachable from the image forming apparatus, the connection device including: a first exterior portion attached to the image forming apparatus, and configured to surround the access portion with an opening part formed by a part of the first exterior portion being open; and a second exterior portion attached to the sheet feeding apparatus, positioned at the opening part of the first exterior portion in a state where the sheet feeding apparatus is connected to the image forming apparatus through the connection device, and configured to surround the access portion together with the first exterior portion.

In addition, according to a second aspect of the present invention, there is provided a sheet feeding unit comprising: a sheet feeding apparatus capable of feeding a sheet, from outside to an apparatus having an access portion accessible to an inside of the apparatus; and a connection device interposed between the apparatus having the access portion and the sheet feeding apparatus, and connecting the sheet feeding apparatus to the apparatus having the access portion such that the sheet feeding apparatus is detachable from the apparatus, the connection device including, a first exterior portion attached to the apparatus having the access portion, and configured to surround the access portion with an opening part formed by a part of the first exterior portion being open, and a second exterior portion attached to the sheet feeding apparatus, positioned at the opening part of the first exterior portion in a state where the sheet feeding apparatus is connected to the apparatus having the access portion through the connection device, and configured to surround the access portion together with the first exterior portion.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Hereinafter, an image forming system according to the present embodiment will be described with reference to the drawings. The image forming system according to the present embodiment is configured so that a sheet feeding apparatus (side deck) capable of storing a large quantity of sheets is connected to an image forming apparatus such as a copier, a printer, a facsimile, and a multifunction machine thereof, via a connection unit. The following embodiment will be described using an electrophotographic laser beam printer (hereinafter, referred to as a "printer") as the image forming apparatus.

Figure 1:
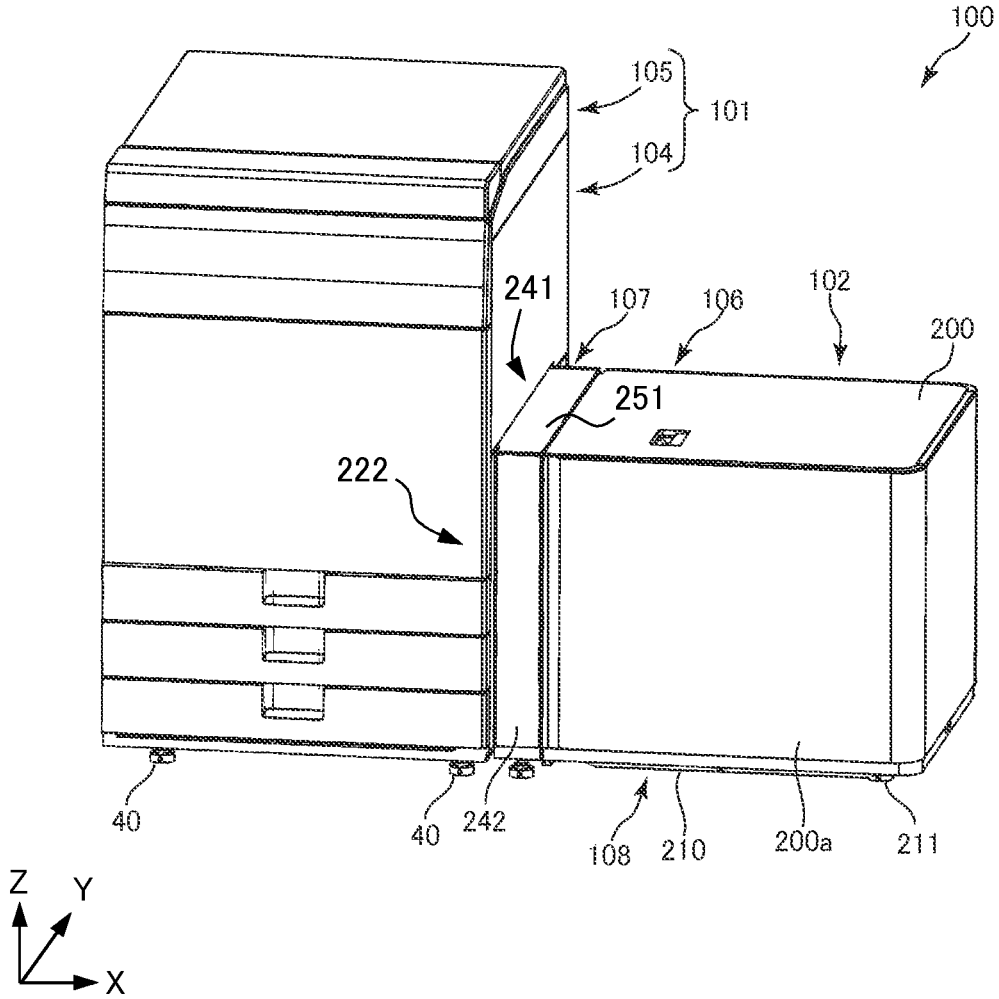
FIG. 1 is a perspective view illustrating a state where a sheet feeding apparatus is connected to a printer via a connection unit in an image forming system according to the present embodiment.
Figure 2:
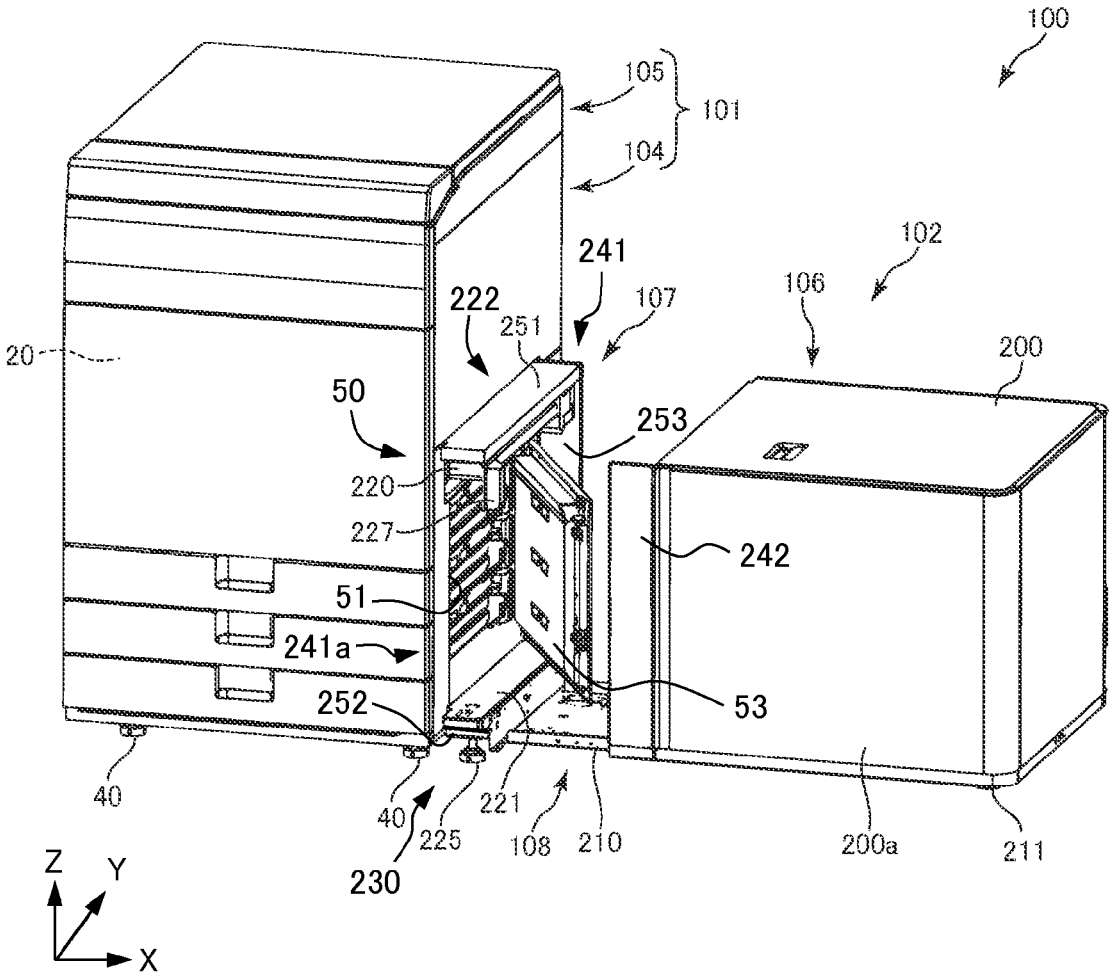
FIG. 2 is a perspective view illustrating a state where the sheet feeding apparatus is separated from the printer and a door of a printer main body is opened in the image forming system according to the present embodiment.
Figure 3:
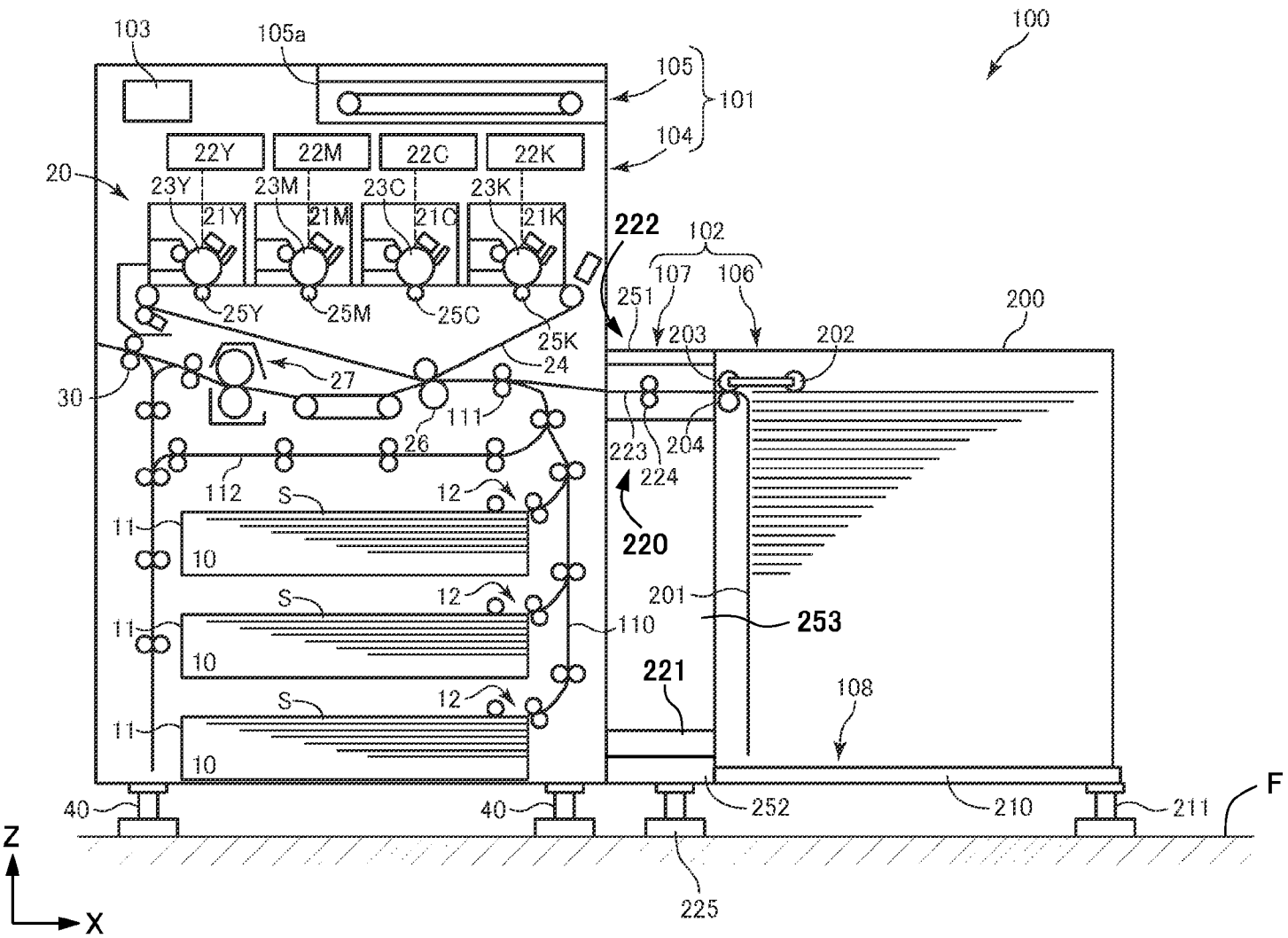
FIG. 3 is a section view illustrating a state where the sheet feeding apparatus is connected to the printer via the connection unit in the image forming system according to the present embodiment.
Figure 4:
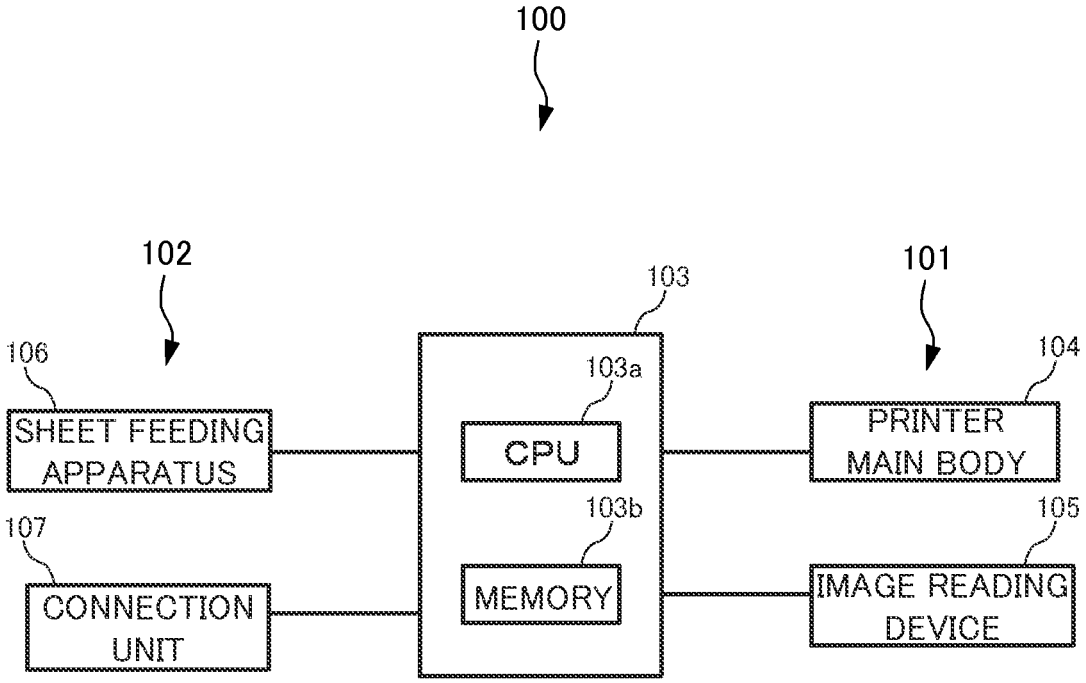
FIG. 4 is a block diagram illustrating a configuration of a control unit in the image forming system according to the present embodiment.

First, a schematic configuration of an image forming system 100 according to the present embodiment will be described with reference to FIGS. 1 to 4. FIG. 1 is a perspective view illustrating the image forming system 100 according to the present embodiment. FIG. 2 is a perspective view illustrating a state where a door 53 of a printer main body 104 illustrated in FIG. 1 is opened. FIG. 3 is a section view of the image forming system 100 illustrated in FIG. 1. FIG. 4 is a block diagram illustrating a configuration of a control unit 103 of the image forming system 100 according to the present embodiment.

In the following description, a position facing an operation portion (not illustrated) by which a user performs various input or setting operations on the image forming system 100 is referred to as a "forward (front) side" of the image forming system 100, and a position opposite thereto is referred to as a "rearward (rear) side". That is, FIG. 3 illustrates an internal configuration of the image forming system 100 when viewed from the forward side. In the present embodiment, for example, as illustrated in FIG. 1, from the front side toward the image forming system 100, a right and left direction (horizontal direction) is referred to as an X-direction, a back and forth direction (depth direction) is referred to as a Y-direction, and an up and down direction (vertical direction, height direction) is referred to as a Z-direction.

As illustrated in FIGS. 1 to 3, the image forming system 100 includes a printer (image forming apparatus) 101, a sheet feeding unit 102 capable of feeding a sheet S to the printer 101, and a control unit 103 controlling the printer 101 and the sheet feeding unit 102.

The printer 101 includes a main body sheet feeding portion 10 feeding a sheet S, an image forming portion 20 forming an image on the sheet S, a sheet conveyance path 110 conveying the sheet S from the main body sheet feeding portion 10 to the image forming portion 20, and a discharge roller pair 30 discharging the sheet S outward from the printer 101 in a printer main body (apparatus main body) 104. Above the printer main body 104, the printer 101 includes an image reading device 105 including a reader portion 105*a* capable of reading image information of the document. And under the printer main body 104, the printer 101 includes a main body adjuster 40 capable of adjusting a height of the printer main body 104. As described above, the printer 101 includes the printer main body 104, the image reading device 105 and the main body adjuster 40.

The main body sheet feeding portion 10 is configured to supply the sheet S to the image forming portion 20. The main body sheet feeding portion 10 includes a feeding sheet stacking portion 11 on which the sheet S is stacked, and a feeding portion 12 feeding the sheet S stacked on the feeding sheet stacking portion 11 while separating the sheet S one by one. In the present embodiment, the above-described portions are disposed in three stages. Each feeding sheet stacking portion 11 is configured to be drawable to the forward side (so-called front-loading type), thereby achieving downsizing of the main body sheet feeding portion 10 in the X-direction (right and left direction).

The image forming portion 20 includes four process cartridges 21Y to 21K forming an image of yellow (Y), magenta (M), cyan (C), and black (K), and exposure devices 22Y to 22K exposing a surface of photosensitive drums 23Y to 23K (to be described later). The four process cartridges 21Y to 21K have the same configuration except that colors for forming the image are different. Therefore, a configuration of the process cartridge 21Y for forming the image of yellow (Y) will be described, and the process cartridges 21M to 21K will be omitted in the description.

The process cartridge 21Y includes the photosensitive drum 23Y, a charging roller charging the photosensitive drum 23Y, and a developing roller developing an electrostatic latent image formed on the photosensitive drum 23Y. The image forming portion 20 includes an intermediate transfer belt 24 in which a toner image on the photosensitive drums 23Y to 23K is subjected to primary transfer, primary transfer rollers 25Y to 25K performing primary transfer of the toner image on the intermediate transfer belt 24, a secondary transfer portion 26 performing secondary transfer of the toner image subjected to the primary transfer, and a fixing portion 27 heating and fixing the toner image subjected to the secondary transfer.

The printer main body 104 has an access portion 50 accessible to the sheet conveyance path 110 inside the printer main body 104. The access portion 50 includes an access port 51 formed in the side of the printer main body 104 and accessible to the inside of the apparatus, and the door 53 for opening and closing the access port 51 by being rotated around a hinge (rotation support portion) 52.

The access port 51 is formed in a side portion on the sheet feeding unit 102 side of the printer main body 104, and opens the sheet conveyance path 110 extending upward from the main body sheet feeding portion 10 toward the image forming portion 20. In the present embodiment, the door 53 is provided to be able to opening and closing the access port 51 by the hinge 52 disposed on a rearward side of the side portion of the printer main body 104 and whose rotation center axis is set to the Z-direction (vertical direction). Inside and outside of the printer main body 104 are connected via the access port 51 by opening the door 53 from the forward side. The door 53 is opened, and an access from the access port 51 to the sheet conveyance path 110 is capable. In this manner, a user can perform processing or maintenance for a sheet jam occurring in or near the sheet conveyance path 110, a replacement of a roller and so on.

The sheet feeding unit 102 includes a sheet feeding apparatus 106 capable of feeding a large quantity of sheets S to the printer main body 104, a connection unit (connection device) 107 for connecting the sheet feeding apparatus 106 to the printer 101 so as to be detachable therefrom, and a movement support portion 108 supporting the sheet feeding apparatus 106 so as to be relatively movable with respect to the printer 101. The sheet feeding unit 102 will be described in detail later.

As illustrated in FIG. 4, the control unit 103 includes a CPU 103*a* for driving and controlling the printer main body 104, the image reading device 105, the sheet feeding apparatus 106, the connection unit 107, and the like, and includes a memory 103*b* for storing various programs, various information items, or the like. The control unit 103 uses the above-described configuration elements, and integrally controls operations of the printer main body 104, the image reading device 105, the sheet feeding apparatus 106, the connection unit 107, and the like, thereby forming an image on the sheet S.

Next, an image forming operation (image forming control performed by the control unit 103) of the image forming system 100 will be described.

If image information is input from the image reading device 105, an external PC, or the like, the exposure devices 22Y to 22K irradiate laser beams to the photosensitive drums 23Y to 23K, based on the input image information. At this time, the photosensitive drums 23Y to 23K are previously charged by the charging roller. An electrostatic latent image is formed on the photosensitive drums 23Y to 23K by the irradiated laser beams. Thereafter, the developing roller develops the electrostatic latent image, and the respective toner images of yellow (Y), magenta (M), cyan (C), and black (K) are formed on the photosensitive drums 23Y to 23K. The toner images of each color which are formed on the photosensitive drums 23Y to 23K are superimposed on and transferred to the intermediate transfer belt 24 by the primary transfer rollers 25Y to 25K, and are conveyed to the secondary transfer portion 26 by the intermediate transfer belt 24.

In conjunction with the above-described image forming operation, the sheets S stacked on the feeding sheet stacking portion 11 are fed to the sheet conveyance path 110 one by one by the feeding portion 12. Then, sheet skewing is corrected by a registration roller pair 111 located downstream of the sheet conveyance path 110. The sheet S is conveyed to the secondary transfer portion 26 at a predetermined conveyance timing, and the toner images on the intermediate transfer belt 24 are transferred. The sheet S having the transferred toner images is discharged outward from the printer 101 by the discharge roller pair 30 after the toner images are fixed by the fixing portion 27. The sheet S discharged outward from the printer 101 is sequentially stacked on a discharge sheet stacking portion (not illustrated).

When the image is formed on both surfaces (first surface and second surface) of the sheet S, the sheet S in which the image is formed on the first surface (front surface) is conveyed to a duplex conveyance path 112. The sheet S is reconveyed to the image forming portion 20 via the duplex conveyance path 112, and the image is formed on the second surface (rear surface).

Next, the above-described sheet feeding unit 102 will be described with reference to FIGS. 5A to 9 in addition to FIGS. 2 and 3.

The sheet feeding apparatus 106 is configured so that more sheets S can be stacked thereon as compared to the feeding sheet stacking portion 11. In the present embodiment, since a feeding path is less bent, the sheet feeding apparatus 106 can preferably feed the sheet (for example, a highly stiff sheet) S which has difficulties in feeding from the feeding sheet stacking portion 11. The connection unit 107 is interposed between the printer 101 and the sheet feeding apparatus 106, and is configured to be capable of delivering and conveying the sheet S fed from the sheet feeding apparatus 106 to the printer 101. The connection unit 107 is used so that one type of the sheet feeding apparatus is generally connected to printers having various specifications.

Figures 5A, 5B:
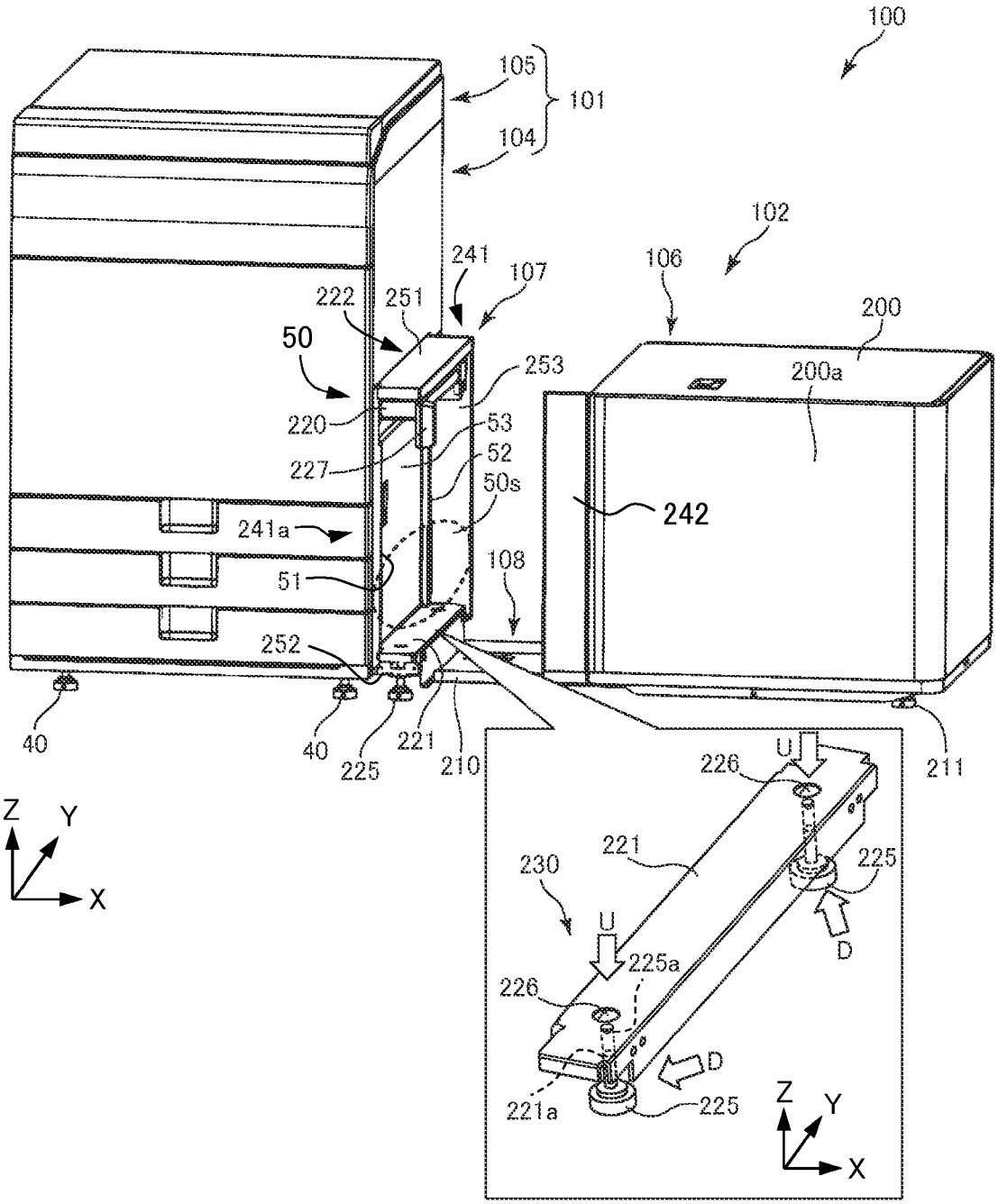
FIG. 5A is a perspective view illustrating a state where the sheet feeding apparatus is separated from the printer in the image forming system according to the present embodiment.
FIG. 5B is a perspective view illustrating a height adjustment portion in the image forming system according to the present embodiment.
Figure 6:
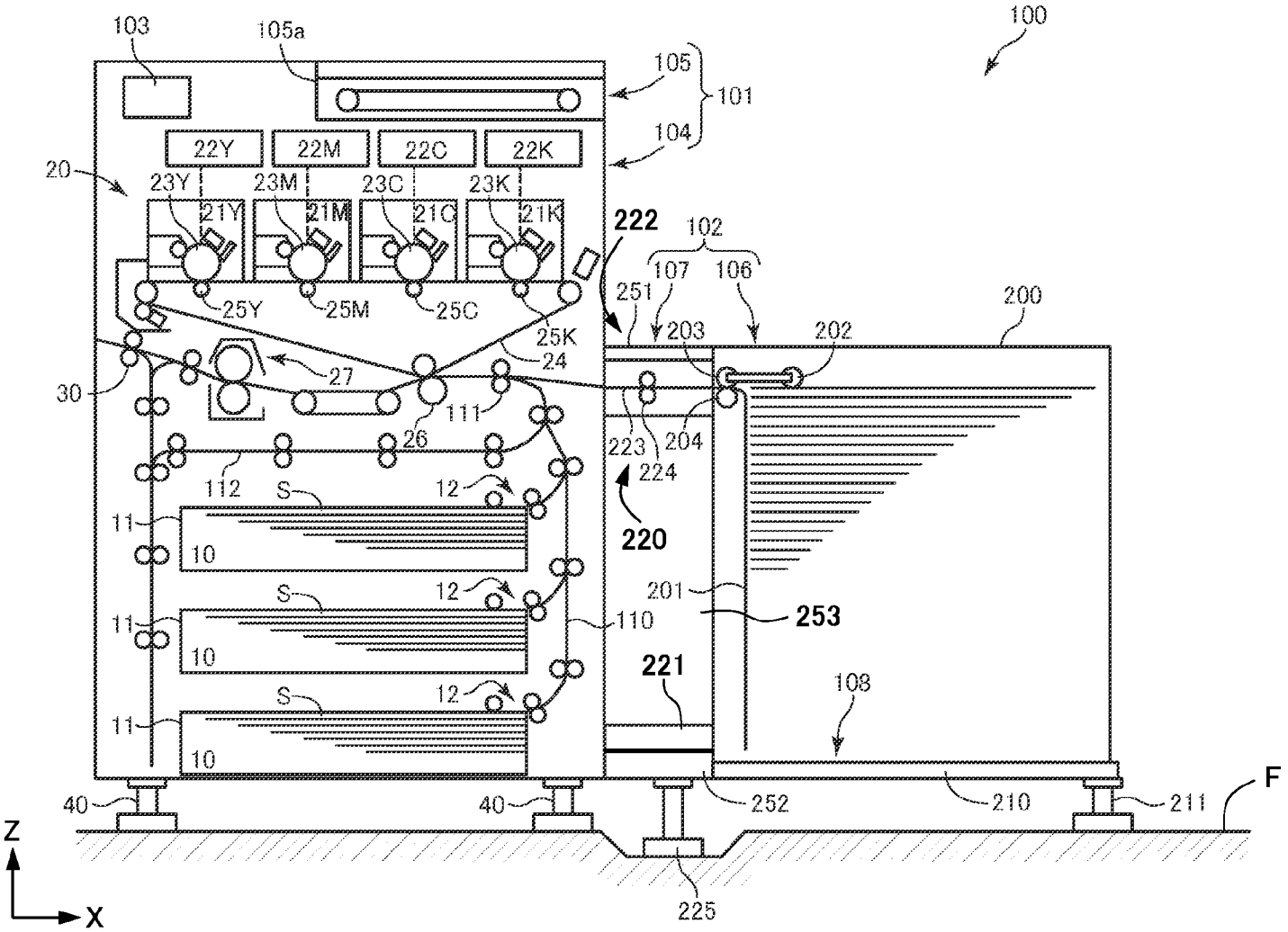
FIG. 6 is a section view illustrating a state where a height of the connection unit is adjusted by an adjuster in the image forming system according to the present embodiment.

First, a schematic configuration of the sheet feeding apparatus 106, the connection unit 107, and the movement support portion 108 will be described with reference to FIGS. 2, 3, 5A, and 6. FIG. 5A is a perspective view illustrating a state where the sheet feeding apparatus 106 is separated from the printer 101. FIG. 6 is a section view illustrating a state where a height of the connection unit 107 is adjusted by an adjuster 225.

As illustrated in FIGS. 2 and 3, the sheet feeding apparatus 106 includes a deck exterior section (casing) 200 configuring an exterior, a container 201 capable of containing a large quantity of sheets S, a feeding roller 202 feeding the sheet S contained in the container 201, and a feeding roller 203 and a retard roller 204 which separate and feed the sheet S fed by the feeding roller 202 one by one.

The container 201 is formed so as to be containable inside the deck exterior section 200, and is configured so as to be drawable from the inside of the deck exterior section 200 by a side rail (not illustrated) disposed on both sides. In addition, the container 201 includes a tray (not illustrated) by which the contained sheet S is supported by being stacked thereon, and a lifting mechanism (not illustrated) for lifting the tray in a horizontal state.

The feeding roller 202, the feeding roller 203, and the retard roller 204 are rubber rollers in which a high friction coefficient material such as rubber is wound around a periphery thereof. When multiple sheets S contained in the container 201 are fed by the feeding roller 202, the retard roller 204 prevents the sheets other than the topmost sheet from being fed, and the feeding roller 203 feeds only the topmost sheet S.

The movement support portion 108 includes a pair of rails 210 moving the sheet feeding apparatus 106 to be slidable and a pair of deck adjusters 211 supporting the pair of rails 210. The pair of rails 210 supports a lower surface of the deck exterior section 200 so that the sheet feeding apparatus 106 is movable in the X-direction. The deck adjuster 211 supports the pair of rails 210 so as to maintain a constant height from a floor F, and is configured to minimize occurrence of deformation or deflection of the pair of rails 210. In addition, the deck adjuster 211 is configured to be capable of adjusting a height. For example, even if the floor F sinks or floats, the side deck adjuster 211 enables the sheet feeding apparatus 106 to be connected to the printer 101 at an accurate position (height). In the present embodiment, a case has been described in which the movement support portion 108 moves the sheet feeding apparatus 106 by using the rail 210. However, without being limited thereto, for example, the movement support portion 108 may move the sheet feeding apparatus 106 by using a caster disposed on the lower surface of the sheet feeding apparatus 106, or the like.

The connection unit 107 is interposed between the printer 101 and the sheet feeding apparatus 106, and is configured to connect the sheet feeding apparatus 106 to the printer 101 so as to be detachable therefrom. The connection unit 107 includes a path unit (conveyance unit) 220 delivering the sheet S, a height adjustment portion 230 capable of adjusting the height of the connection unit 107 with respect to the floor F, an exterior section 222 configuring an exterior, and a guide portion 227.

As illustrated in FIG. 5A, the path unit 220 is configured to convey the sheet S fed from the sheet feeding apparatus 106 to the printer 101. The path unit 220 is fixed to the exterior section 222 and the printer main body 104 so as to be substantially parallel to an upper edge of the door 53, above the door 53 of the printer main body 104 so that an open space 50*s* capable of opening the door 53 is disposed between the height adjustment portion 230 and the path unit 220. In addition, the path unit 220 includes a conveyance path 223 for conveying the sheet S fed by the feeding roller 202 to the printer 101, and a conveyance roller pair 224 conveying the sheet S fed to the conveyance path 223 to the printer 101. The conveyance path 223 is connected to an upstream portion of the registration roller pair 111 in the sheet conveyance path 110 of the printer main body 104.

The height adjustment portion 230 includes a support unit (support member) 221 to which one end of the pair of rails 210 is connected, and the adjuster 225 which is screwed into the support unit 221 and capable of adjusting the height. The support unit 221 is fixed to the exterior section 222 and the printer main body 104 so as to be substantially parallel to a lower edge of the door 53, below the door 53 so that an open space 50*s* capable of opening the door 53 is disposed between the path unit 220 and the support unit 221. The support unit 221 has a female screw portion 221*a* whose vertical direction serves as the axial direction. The adjuster 225 has a male screw portion 225*a* screwed into the female screw portion 221*a*, and is configured to be capable of adjusting the height of the connection unit 107 by being rotated and vertically moved with respect to the support unit 221 in a state where a lower end portion thereof is in contact with the floor F. The relative height of the connection unit 107 with respect to the printer 101 is adjusted by rotating the adjuster 225 around the axis. As illustrated in FIG. 6, for example, even if the floor F sinks or floats, the adjuster 225 enables the sheet feeding apparatus 106 to be connected to the printer 101 at an accurate position (height).

In addition, the support unit 221 includes an attachment hole (through-hole) 226 of the adjuster 225. The attachment hole 226 penetrates the support unit 221 upward from the female screw portion 221*a*. In the related art, the support unit 221 accesses the adjuster 225 in only a direction indicated by arrow D (downward and sideways) illustrated in FIG. 5B. However, since the attachment hole 226 penetrates the support unit 221, the support unit 221 can also be rotatably operated by accessing the adjuster 225 from a direction indicated by arrow U (upward) illustrated in FIG. 5B. In this manner, even when the printer 101 is installed in a place where rear space is insufficient for a work space, the support unit 221 can be rotatably operated by accessing the adjuster 225 from the open space 50*s*. Accordingly, work for adjusting the height is further facilitated as compared to a case of accessing the adjuster 225 from the floor F side.

Figure 7:
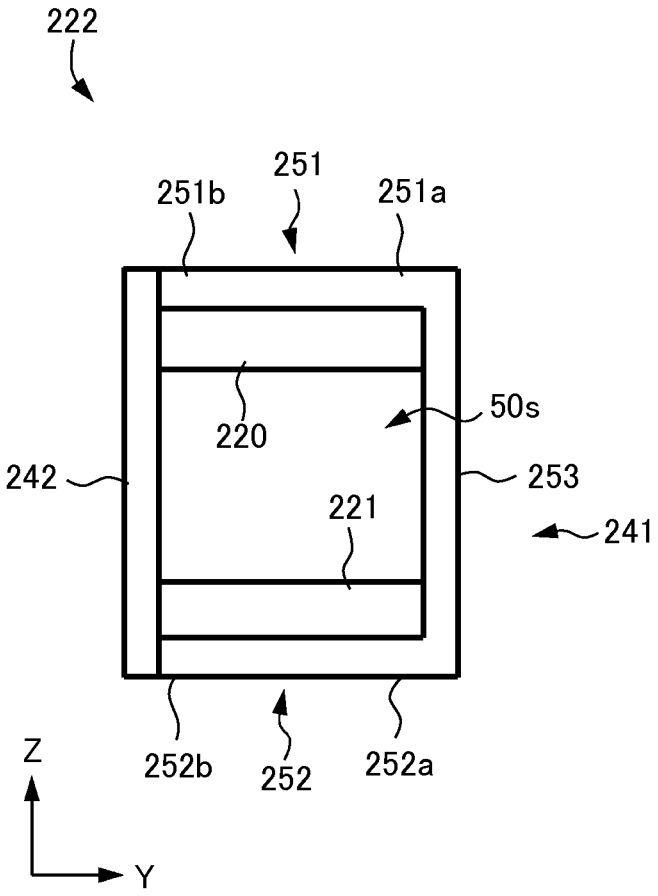
FIG. 7 is a view for describing a state where an exterior portion of the image forming system according to the present embodiment is viewed from the sheet feeding apparatus.

The exterior section 222 is arranged so as to surround the path unit 220 and the support unit 221 from outside. The exterior section 222 includes a first exterior portion 241 attached to the printer 101, and a second exterior portion 242 attached to the sheet feeding apparatus 106. That is, the first exterior portion 241 and the second exterior portion 242 can be individually separated from each other. In the present embodiment, as illustrated in FIG. 7, the exterior section 222 is configured to have a substantially rectangular shape. One side on the forward side out of four sides configuring the rectangular shape configures the second exterior portion 242, and the other three sides out of the four sides configure the first exterior portion 241.

The first exterior portion 241 is configured to surround the access portion 50 by a portion thereof being open. In addition, the first exterior portion 241 includes a first exterior member 251 disposed at an above side of the access portion 50, a second exterior member 252 formed to oppose the first exterior member 251 and disposed at a below side of the access portion 50, and a third exterior member 253 disposed at a side (rearward side) of the access portion 50 by connecting respective first end portions 251*a* and 252*a* of the first exterior member 251 and the second exterior member 252. The first exterior portion 241 has an opening portion 241*a* on a side opposite to the hinge 52 across the access port 51, that is, on the forward side of the access portion 50. The path unit 220 is fixedly attached to the inside of the first exterior member 251. That is, a side to which the first exterior portion 241 opens is a front side of the printer 101.

The second exterior portion 242 is disposed at the opening portion 241*a* of the first exterior portion 241 in a state where the sheet feeding apparatus 106 is connected to the printer 101 via the connection unit 107, and is configured to surround the access portion 50 together with the first exterior portion 241. The second exterior portion 242 is configured to close an opening portion 241*a* between respective second end portions 251*b* and 252*b* of the first exterior member 251 and the second exterior member 252, that is, the opening portion 241*a*, in a state where the sheet feeding apparatus 106 is connected to the printer 101 via the connection unit 107. The second exterior portion 242 is fixed to a front exterior 200*a* of the sheet feeding apparatus 106 by a screw (not illustrated) so that a relative position is adjustable in the horizontal direction and the vertical direction. The second exterior portion 242 is moved integrally with the sheet feeding apparatus 106.

The guide portion 227 is disposed in the second end portion 251*b* of the first exterior member 251 (alternatively, an end portion on the forward side of the path unit 220). When the sheet feeding apparatus 106 is connected to the connection unit 107, the guide portion 227 guides the second exterior portion 242 of the connection unit 107 to a predetermined position, and holds the second exterior portion 242 at the predetermined position. That is, when the sheet feeding apparatus 106 is connected to the printer 101 via the connection unit 107, the guide portion 227 guides the second exterior portion 242 to the predetermined position, and causes the second exterior portion 242 to be guided so as not to interfere with the first exterior member 241 and the path unit 220. Furthermore, when the sheet feeding apparatus 106 is connected to the printer 101 via the connection unit 107, the guide portion 227 guides the second exterior portion 242 so that a gap is removed between the first exterior portion 241 and the second exterior portion 242. Therefore quality in appearance of the apparatus is maintained and when the sheet feeding apparatus 106 is connected to the connection unit 107, damage to the second exterior portion 242 or interference-received peripheral members is prevented. That is, a predetermined position of the second exterior portion 242 in the present embodiment is configured to be a position where the second exterior portion 242 is disposed so as to be fitted to the first exterior portion 241 without a gap and does not interfere with the first exterior member 241 and the path unit 220.

Figure 8A:
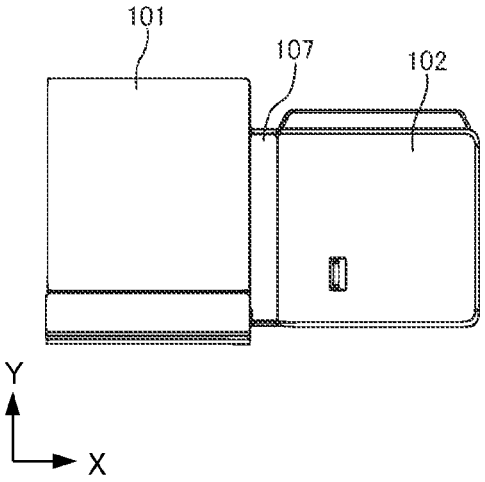
FIG. 8A is a plan view illustrating a state where the sheet feeding apparatus is connected to the printer via the connection unit in the image forming system according to the present embodiment.
Figure 8C:
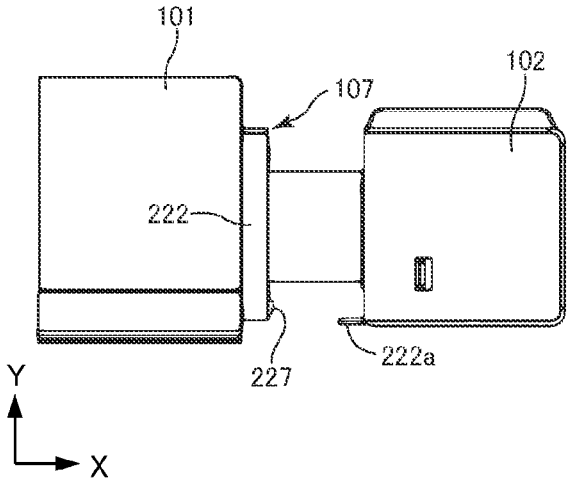
FIG. 8C is a plan view illustrating a state where the sheet feeding apparatus is separated from the printer in the image forming system according to the present embodiment.
Figure 8B:
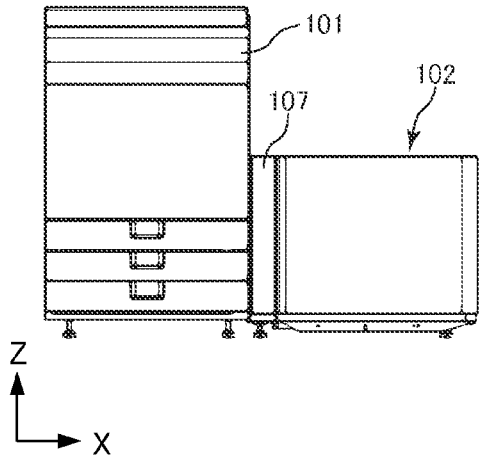
FIG. 8B is a front view illustrating a state where the sheet feeding apparatus is connected to the printer via the connection unit in the image forming system according to the present embodiment.
Figure 8D:
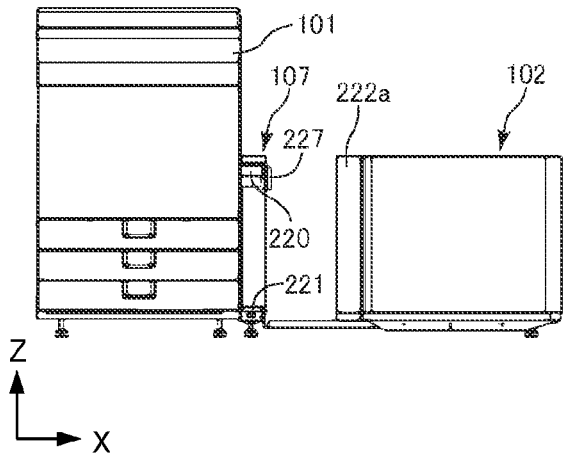
FIG. 8D is a front view illustrating a state where the sheet feeding apparatus is separated from the printer in the image forming system according to the present embodiment.
Figure 9:
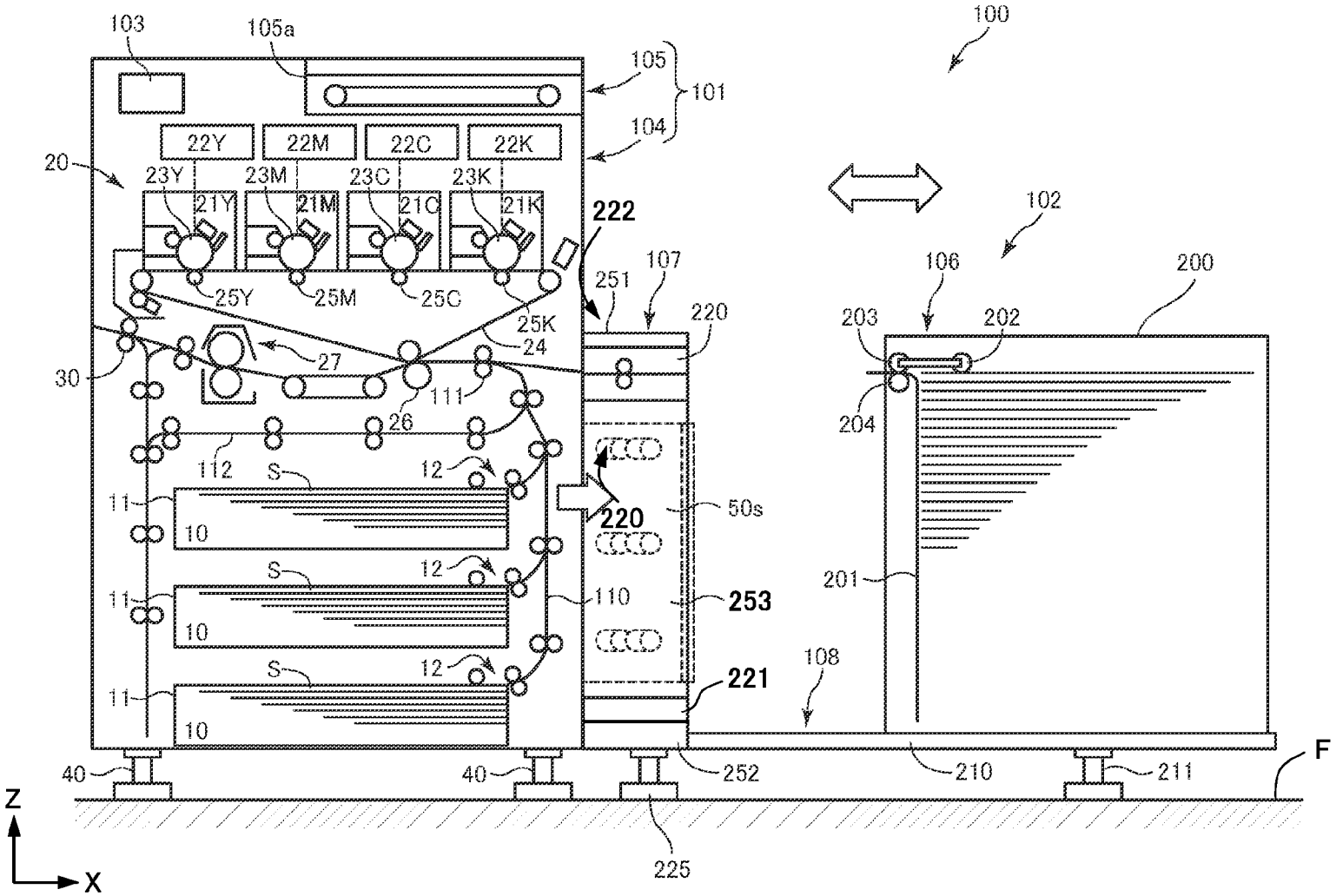
FIG. 9 is a section view illustrating a state where the sheet feeding apparatus is separated from the printer in the image forming system according to the present embodiment.

Next, a sheet feeding operation performed by the sheet feeding apparatus 106 (sheet feeding operation performed by the control unit 103) will be described with reference to FIGS. 8A to 9. FIGS. 8A and 8B are views for describing a state where the sheet feeding apparatus 106 is connected to the printer 101 via the connection unit 107. FIGS. 8C and 8D are views for describing a state where the sheet feeding apparatus 106 is separated from the printer 101. FIG. 9 is a section view illustrating a state where the sheet feeding apparatus 106 is separated from the printer 101.

If the sheet feeding apparatus 106 is connected to the printer 101 via the connection unit 107, the sheet feeding apparatus 106 and the printer 101 are electrically connected to each other, thereby enabling the sheet feeding apparatus 106 to be controlled by the control unit 103. From this state, the container 201 is first drawn out from the deck exterior section 200, and the sheet S is set on a tray of the container 201 from above. The container 201 is drawn out from the deck exterior section 200, thereby ensuring a work space for setting the sheet S. If the sheet S is set on the tray, a side regulating plate and a rear end regulating plate (both are not illustrated) are caused to match a sheet size, thereby regulating a feeding position of the sheet S.

If the container 201 in which the sheet S is set is contained in the deck exterior section 200, the tray starts to ascend by a lifting portion. A height detection sensor is disposed in the feeding roller 202. If the ascending of the tray causes the topmost sheet S to press the feeding roller 202 up to the predetermined position, the height detection sensor outputs a detection signal. In this manner, the control unit 103 controls the lifting portion to stop the tray based on the detection signal, and the tray is maintained at the predetermined position where the topmost sheet S can be fed.

Thereafter, if the sheet S starts to be fed and the height of the topmost sheet S is lowered, the tray ascends again. Then, the tray is stopped when the feeding roller 202 reaches the predetermined position. The sheet S is fed to the printer main body 104 while this operation is repeated. If feeding of the instructed number of sheets S is completed, the feeding roller 202 is stopped.

Here, if a sheet jam occurs in the sheet conveyance path 110 of the printer main body 104, processing of the sheet jam is performed by a user. When the processing of the sheet jam is performed, the sheet feeding apparatus 106 is first moved in a direction away from the side of the printer 101 so that the sheet feeding apparatus 106 is separated therefrom, from the connection state illustrated in FIGS. 8A and 8B. At this time, as illustrated in FIGS. 8C and 8D, the second exterior portion 242 of the connection unit 107 is connected to the sheet feeding apparatus 106. Accordingly, the second exterior portion 242 is moved together with the sheet feeding apparatus 106. If the second exterior portion 242 is moved, as illustrated in FIG. 9, the open space 50*s* is exposed, thereby enabling the door 53 to be opened or closed. At this time, there is no possibility that the path unit 220 and the support unit 221 interfere in opening and closing the door 53.

Thereafter, the door 53 is opened so as to perform the processing of the sheet jam. If the processing of the sheet jam is completed, the door 53 is closed. If the door 53 is closed, the sheet feeding apparatus 106 is moved toward the printer main body 104 along the pair of the rails 210, and is connected to the printer 101 via the connection unit 107. At this time, the guide portion 227 holds the second exterior portion 242 at the predetermined position, and the second exterior portion 242 is configured so that a relative position thereof at the predetermined position is adjusted in advance. Therefore, the second exterior portion 242 is reliably located at the predetermined position. Accordingly, it is possible to maintain a quality in appearance of the entire apparatus.

As described above, in the image forming system 100 according to the present embodiment, the second exterior portion 242 of the connection unit 107 is connected to the sheet feeding apparatus 106. Therefore, when the sheet feeding apparatus 106 is moved in order to perform the processing of the sheet jam or maintenance, the second exterior portion 242 can be moved integrally with the sheet feeding apparatus 106. Here, for example, in a case where the exterior section 222 of the connection unit 107 is entirely disposed in the printer 101, as compared to a case where the exterior section 222 is not disposed in the printer 101, user's accessibility to the door 53 and the inside of the printer 101 becomes poor. In this case, in an opening operation of the door 53, in the processing of the sheet jam, or the like, there is a possibility that visibility and operability become poor, thereby resulting in deteriorated work efficiency.

In contrast, in the image forming system 100 according to the present embodiment, the exterior section 222 of the connection unit 107 is not entirely disposed in the printer 101. Only the first exterior portion 241 which is one portion of the exterior section 222 is connected to the printer 101, and the second exterior portion 242 which is the other portion of the exterior section 222 is connected to the sheet feeding apparatus 106. This can decrease a possibility that the connection unit 107 interferes with a worker during the processing of the sheet jam or the maintenance. As a result, the accessibility to the inside of the printer 101 is improved. Accordingly, it is possible to improve the workability.

In particular, according to the image forming system 100 of the present embodiment, the opening portion 241*a* of the first exterior portion 241 is arranged on the side opposite to the hinge 52 across the access port 51. Therefore, there is no possibility that the end portion on the opening and closing side of the door 53 is blocked by the first exterior portion 241. In this manner, as compared to a case where the opening portion 241*a* is located at the other portion, it is possible to further improve the workability in opening and closing the door 53 and the workability in the processing of the sheet jam or the maintenance work after the door 53 is opened.

In addition, the second exterior portion 242 is fixed to the sheet feeding apparatus 106. Therefore, it is possible to prevent a loss or damage during the work.

Furthermore, if the second exterior portion 242 is fixed to the printer main body 104, it is necessary to detach the second exterior portion 242 from the printer main body 104 when the work is started, or to carry out work so that a worker does not interfere with the second exterior portion 242. However, this work is no longer required. Therefore, it is possible to shorten a period of time required for the work.

Hitherto, the present embodiment has been described. However, the present invention is not limited to the above-described embodiment. In addition, the advantageous effect described in the present embodiment is merely an example for showing the most preferable advantageous effect achieved by the present invention. Accordingly, the advantageous effect according to the present invention is not limited to the advantageous effect described in the present embodiment.

For example, in the present embodiment, a case has been described in which the second exterior portion 242 attached to the sheet feeding apparatus 106 is configured to entirely have one side on the forward side of the exterior section 222. However, the present embodiment is not limited thereto. For example, the second exterior portion 242 may be configured to have one portion of one side on the forward side, and the other portion of one side on the forward side may configure a portion of the first exterior portion 241. In this manner, the second exterior portion 242 may be attached to the printer 101.

In addition, in the present embodiment, a case has been described in which the door 53 is supported so as to be openable or closeable by the hinge 52 disposed on the rearward side of the door 53 and whose rotation center axis is set to the vertical direction. However, the present embodiment is not limited thereto. For example, the hinge whose rotation center axis is set to the horizontal direction may be disposed below the door. In this manner, the door may be supported so as to be openable or closeable by the hinge. In this case, the door is configured so that an upper portion is opened or closed. Therefore, it is preferable that one portion configuring an upper side of the exterior section 222 be attached to the sheet feeding apparatus 106 as the second exterior portion 242 and the other portion be attached to the printer 101 as the first exterior portion 241. In this case, similar to the above-described embodiment, when the sheet feeding apparatus 106 is moved in order to perform the processing of the sheet jam or the maintenance, the second exterior portion 242 can also be moved integrally with the sheet feeding apparatus 106. Therefore, it is possible to decrease a possibility that the connection unit 107 interferes with a worker.

In addition, the present embodiment has been described using the electrophotographic printer. However, the present invention is not limited thereto. For example, it is also possible to use an ink jet printer (image forming apparatus) forming an image on a sheet by ejecting an ink droplet through a nozzle.

In addition, in the present embodiment, a case has been described in which the sheet S fed from the sheet feeding unit 102 is supplied to the printer 101. However, the present embodiment is not limited thereto. For example, the sheet feeding unit 102 may be installed on a working line for performing post-processing. In this manner, the sheet feeding unit 102 can be applied to the sheet feeding unit such that the sheet S may be directly supplied to a sheet processing apparatus such as a finisher in addition to the image forming apparatus such as the printer 101. That is, the sheet feeding unit 102 can be widely applied to the image forming apparatus such as the printer 101, the sheet processing apparatus such as the finisher, and the like, since the sheet S is supplied to an apparatus having the access portion 50 for accessing the inside of the apparatus in order to perform the processing of the sheet jam of the sheet S.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions thereof.

This application claims the benefit of Japanese Patent Application No. 2013-213991, filed on Oct. 11, 2013, and Japanese Patent Application No. 2014-203686, filed on Oct. 2, 2014, which are hereby incorporated by reference herein in their entirety.

What is claimed is:

1. An image forming system comprising:

an image forming apparatus including an apparatus main body having an access portion accessible to an inside of an apparatus, and an image forming portion provided in the apparatus main body, and forming an image on a sheet;

a sheet feeding apparatus configured to feed the sheet to the image forming apparatus from outside of the apparatus main body; and a connection device interposed between the image forming apparatus and the sheet feeding apparatus, and connecting the sheet feeding apparatus to the image forming apparatus such that the sheet feeding apparatus is detachable from the image forming apparatus, the connection device including:

a first exterior portion attached to the image forming apparatus, and configured to surround the access portion with an opening part formed by a part of the first exterior portion being open; and a second exterior portion attached to the sheet feeding apparatus, positioned at the opening part of the first exterior portion in a state where the sheet feeding apparatus is connected to the image forming apparatus through the connection device, and configured to surround the access portion together with the first exterior portion, wherein the access portion has a door for opening and closing an access opening to access the inside of the apparatus main body by being rotated around a rotation support portion; and wherein the opening part of the first exterior portion is formed on a side opposite to the rotation support portion across the access opening.

2. The image forming system according to claim 1, wherein a side to which the first exterior portion opens is a front side of the image forming apparatus.

3. The image forming system according to claim 1, wherein the connection device includes a conveyance unit provided integrally with the apparatus main body at an inside of the first exterior portion, and conveying the sheet fed from the sheet feeding apparatus to the image forming apparatus.

4. The image forming system according to claim 1, further comprising:

a movement support portion supporting the sheet feeding apparatus such that the sheet feeding apparatus is relatively movable with respect to the image forming apparatus.

5. The image forming system according to claim 1, wherein the connection device includes a guide portion guiding the second exterior portion to a predetermined position when the sheet feeding apparatus is connected to the image forming apparatus through the connection device.

6. The image forming system according to claim 1, wherein the first exterior portion has a first exterior member surrounding the access portion from above, a second exterior member formed to oppose the first exterior member, and surrounding the access portion from below, and a third exterior member surrounding the access portion from the side by connecting respective first end portions of the first and second exterior members, and wherein the second exterior portion closes the opening part between respective second end portions of the first and second exterior members.

7. The image forming system according to claim 6, further comprising:

a rail slidably supporting the sheet feeding apparatus, wherein the connection device includes a conveyance unit provided integrally with the apparatus main body with the first exterior member at an inside of the first exterior portion, and conveying the sheet fed from the sheet feeding apparatus to the image forming apparatus, and a guide portion disposed in the second end portion of the first exterior member, and guiding the second exterior portion such that the second exterior portion does not interfere with the first exterior member and the conveyance unit in sliding the sheet feeding apparatus on the rail.

8. The image forming system according to claim 1, wherein the image forming apparatus includes a main body sheet feeding portion built in the apparatus main body, and feeding the sheet to the image forming portion, and a sheet conveyance path conveying the sheet fed from the main body sheet feeding portion to the image forming portion, and wherein the access portion is configured to be accessible to the sheet conveyance path inside the apparatus main body.

9. The image forming system according to claim 1, wherein the connection device includes a height adjustment portion capable of adjusting a height of the connection device with respect to a floor.

10. The image forming system according to claim 9, wherein the height adjustment portion includes a support member having a female screw portion whose axial direction serves as a vertical direction, and attached to the first exterior portion, and an adjuster having a male screw portion screwed into the female screw portion, and configured to adjust the height of the connection device by being rotated and vertically moved with respect to the support member in a state of being in contact with the floor, and wherein the support member has a through-hole penetrating the support member upward from the female screw portion, causing the adjuster to be rotatably operated from above the support member.

11. A sheet feeding unit comprising:

a sheet feeding apparatus configured to feed a sheet, from outside to an apparatus having an access portion accessible to an inside of the apparatus; and a connection device interposed between the apparatus having the access portion and the sheet feeding apparatus, and connecting the sheet feeding apparatus to the apparatus having the access portion such that the sheet feeding apparatus is detachable from the apparatus, the connection device including, a first exterior portion attached to the apparatus having the access portion, and configured to surround the access portion with an opening part formed by a part of the first exterior portion being open; and a second exterior portion attached to the sheet feeding apparatus, positioned at the opening part of the first exterior portion in a state where the sheet feeding apparatus is connected to the apparatus having the access portion through the connection device, and configured to surround the access portion together with the first exterior portion, wherein the access portion has a door for opening and closing an access opening to access the inside of the apparatus main body by being rotated around a rotation support portion, and wherein the opening part of the first exterior is formed on a side opposite to the rotation support portion across the access opening.

12. The sheet feeding unit according to claim 11, wherein a side to which the first exterior portion opens is a front side of the apparatus having the access portion.

13. The sheet feeding unit according to claim 11, wherein the connection device includes a guide portion guiding the second exterior portion to a predetermined position in a case that the sheet feeding apparatus is connected to the apparatus having the access portion through the connection device.

14. The sheet feeding unit according to claim 11, wherein the first exterior portion has a first exterior member surrounding the access portion from above, a second exterior member formed to oppose the first exterior member, and surrounding the access portion from below, and a third exterior member surrounding the access portion from the side by connecting respective first end portions of the first and second exterior members, and wherein the second exterior portion closes the opening part between respective second end portions of the first and second exterior members.

15. The sheet feeding unit according to claim 14, further comprising:

a rail slidably supporting the sheet feeding apparatus, wherein the connection device includes a conveyance unit provided integrally with the apparatus having the access portion with the first exterior member at an inside of the first exterior portion, and conveying the sheet fed from the sheet feeding apparatus to the apparatus having the access portion, and a guide portion disposed in the second end portion of the first exterior member, and guiding the second exterior portion such that the second exterior portion does not interfere with the first exterior member and the conveyance unit in sliding the sheet feeding apparatus on the rail.

16. The sheet feeding unit according to claim 11, wherein the apparatus having the access portion includes a main body sheet feeding portion built in the apparatus having the access portion, and feeding the sheet, and a sheet conveyance path conveying the sheet fed from the main body sheet feeding portion, and wherein the access portion is configured to be accessible to the sheet conveyance path inside the apparatus having the access portion.

17. A image forming system comprising;

an image forming apparatus including an apparatus main body having an access portion accessible to an inside of a apparatus, and an image forming portion provided in the apparatus main body, and forming an image on a sheet;

a sheet feeding apparatus capable of feeding the sheet to the image forming apparatus from outside of the apparatus main body; and a connection device interposed between the image forming apparatus and the sheet feeding apparatus, and connecting the sheet feeding apparatus to the image forming apparatus such that the sheet feeding apparatus is detachable from the image forming apparatus, the connection device including:

a first exterior portion attached to the image forming apparatus, and configured to surround the access portion with an opening part formed by a part of the first exterior portion being open; and a second exterior portion attached to the sheet feeding apparatus, positioned at the opening part of the first exterior portion in a state where the sheet feeding apparatus is connected to the image forming apparatus through the connection device, and configured to surround the access portion together with the first exterior portion, wherein the connection device includes a conveyance unit provided integrally wit the apparatus main body at an inside of the first exterior portion, and conveying the sheet fed from the sheet feeding apparatus to the image forming apparatus.

18. An image forming system comprising:

an image forming apparatus including an apparatus main body having an access portion accessible to an inside of a apparatus, and an image forming portion provided in the apparatus main body, and forming an image on a sheet;

a sheet feeding apparatus capable of feeding the sheet to the image forming apparatus from outside of the apparatus main body; and a connection device interposed between the image forming apparatus and the sheet feeding apparatus, and connecting the sheet feeding apparatus to the image forming apparatus such that the sheet feeding apparatus is detachable from the image forming apparatus, the connection device including:

a first exterior portion attached to the image forming apparatus, and configured to surround the access portion with an opening part formed by a part of the first exterior portion being open; and a second exterior portion attached to the sheet feeding apparatus, positioned at the opening part of the first exterior portion in a state where the sheet feeding apparatus is connected to the image forming apparatus through the connection device, and configured to surround the access portion together with the first exterior portion, wherein the first exterior portion has a first exterior member surrounding that access portion from above, a second exterior member formed to oppose the first exterior member, and surrounding the access portion from below, and a third exterior member surrounding the access portion from the side by connecting respective first end portions of the first and second exterior member, and wherein the second exterior portion closes the opening part between respective second end portions of the first and second exterior members.

19. An image forming system comprising:

an image forming apparatus including an apparatus main body having an access portion accessible to an inside of a apparatus, and an image forming portion provided in the apparatus main body, and forming an image on a sheet;

a sheet feeding apparatus capable of feeding the sheet to the image forming apparatus from outside of the apparatus main body; and a connection device interposed between the image forming apparatus and the sheet feeding apparatus, and connecting the sheet feeding apparatus to the image forming apparatus such that the sheet feeding apparatus is detachable from the image forming apparatus, the connection device including:

a first exterior portion attached to the image forming apparatus, and configured to surround the access portion with an opening part formed by a part of the first exterior portion being open; and a second exterior portion attached to the sheet feeding apparatus, positioned at the opening part of the first exterior portion in a state where the sheet feeding apparatus is connected to the image forming apparatus through the connection device, and configured to surround the access portion together with the first exterior portion, wherein the connection device includes a height adjustment portion configured to adjust a height of the connection device with respect to a floor.

20. A sheet feeding unit comprising:

a sheet feeding apparatus configured to feed a sheet, from outside to an apparatus having an access portion accessible to an inside of the apparatus; and a connection device interposed between the apparatus having the access portion and the sheet feeding apparatus, and connecting the sheet feeding apparatus to the apparatus having the access portion such that sheet feeding apparatus is detachable from the apparatus, the connection device including, a first exterior portion attached to the apparatus having the access portion, and configured to surrounding the access portion with an opening part formed by a part of the first exterior portion being open; and a second exterior portion attached to the sheet feeding apparatus, positioned at the opening part of the first exterior portion in a state where the sheet feeding apparatus is connected to the apparatus having the access portion through the connection device, and configured to surround the access portion together with the first exterior portion, wherein the first exterior portion has a first exterior member surrounding the access portion from above, a second exterior member formed to oppose the first exterior member, and surrounding the access portion from below, and a third exterior member surrounding the access portion from the side by connecting respective first end portion of the first and second exterior members, and wherein the second exterior portion closes the opening part between respective second end portions of the first and second exterior members.

* * * * *